United States Patent [19]

Lee

[11] Patent Number: 4,783,869

[45] Date of Patent: Nov. 15, 1988

[54] ROTATIVE TOOTHBRUSH

[76] Inventor: Yu S. Lee, 283-13, Bukgajwa-dong, Seodaemun-ku, Seoul, Rep. of Korea

[21] Appl. No.: 29,712

[22] Filed: Mar. 24, 1987

[30] Foreign Application Priority Data

Mar. 24, 1986 [KR] Rep. of Korea ..... 86-3567
Jul. 21, 1986 [KR] Rep. of Korea ..... 86-10550
Jul. 25, 1986 [KR] Rep. of Korea ..... 86-10911

[51] Int. Cl.[4] ..... A46B 13/08
[52] U.S. Cl. ..... 15/22 R; 15/26
[58] Field of Search ..... 15/22 R, 22 A, 22 C, 15/26

[56] References Cited

U.S. PATENT DOCUMENTS 1,415,760 5/1922 Alles ..... 15/22
1,481,891 1/1924 Cruikshank ..... 15/26
1,565,479 12/1925 Lorraine et al. ..... 15/26
2,660,745 12/1953 Yusko ..... 15/22 R
4,010,506 3/1977 Young et al. ..... 15/22 R

FOREIGN PATENT DOCUMENTS 715040 9/1931 France ..... 15/22 R
307862 5/1933 Italy ..... 15/26
316125 11/1956 Switzerland ..... 15/26

*Primary Examiner*—Edward L. Roberts
*Attorney, Agent, or Firm*—Birch, Stewart, Kolasch & Birch

[57] ABSTRACT

A toothbrush comprising a brushhead, a shaft having a plurality of net-shaped grooves, a ring having a plurality of projecting members for engaging with the grooves of the shaft, and a tubular gripping member for receiving the shaft with the ring and a cap whereby the toothbrush is longitudinally and rotably movable within the gripping member.

1 Claim, 4 Drawing Sheets

ROTATIVE TOOTHBRUSH

The present invention relates to a rotative toothbrush which can brush the teeth vertically up and down as well as horizontally right and left when the user moves the toothbrush right and left in conventional way.

The effective way of brushing the teeth is to brush the teeth vertically up and down as well as horizontally right and left. This invention is concerned with the toothbrush which automatically moves up and down while the user brushes his teeth right and left in conventional way and removes the food dirts and the plaque from the teeth.

PRIOR ARTS

A toothbrush which has most frequently been used is the one which can be moved right and left by user's hand. In order to move the toothbrush up and down in the mouth, the user must move the toothbrush up and down by hand but such hand-moving is a very tedious movement for the user. Various toothbrushes have been invented to brush the teeth up and down (Japanese Utility Model Publication Nos. 54-8933, 54-8934, 58-16663 and 59-107). All of them are the ones powered electrically with a rotating brush to clean the teeth in a vertical way. However, they have lots of problems for putting them into practical use, as they are very expensive and they often get out of order becaue of their continuous touch with water and they also need separate source of electrical power.

OBJECT OF THE INVENTION

The object of the present invention is to provide a new toothbrush which can be moved up and down as well as right and left when the user moves the toothbrush right and left in a conventional way. The toothbrush is composed of a brushhead and a grip connected with a shaft. The grip is a cylinder-like shape in the inner part with sloped, or curved groove in it. The shaft has projections on its middle part. Or, the cylinder grip has projections in it and the shaft has net-like groove in it. Therefore, the projections on the shaft are guided by the groove making the brushhead be rotative or the projections in the cylinder are guided by the net-like groove on the shaft making the brushhead move up and down. Ordinary right-left movement of the brushhead causes reactive force by friction with the teeth and the projections on the shaft are guided along the groove in the cylinder. Thus, the brushhead is moved up and down as well as right and left cleaning the teeth most effectively.

DETAILED DESCRIPTION OF THE INVENTION

Figure 1:
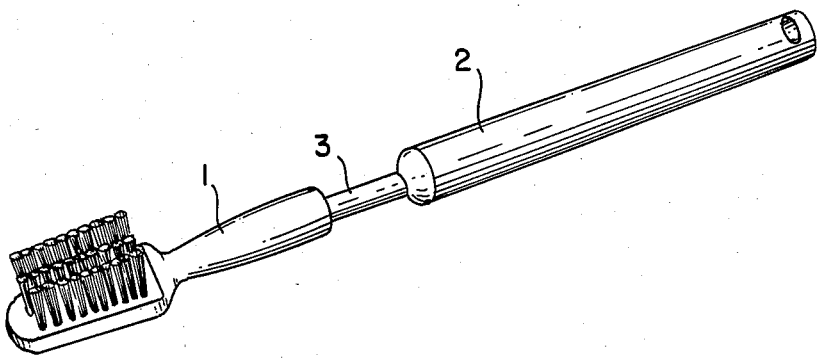
FIG. 1 is a perspective view showing the toothbrush of the present invention.
Figure 2:
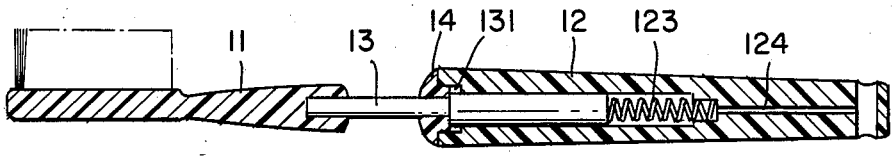
FIG. 2 is a diagram explaining relative arrangement among the brushhead, the shaft, the grip and the spring of FIG. 1 of the example of the present invention.
Figure 3:
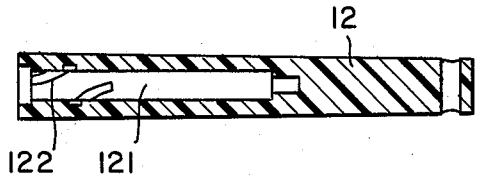
FIG. 3 is a diagram showing the inner front part of the grip of the FIG. 2.
Figure 4:
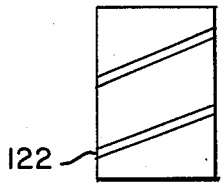
FIG. 4 is an unfolded view showing the grooves of FIG. 2.

FIG. 1 shows the external form of the rotative toothbrush of the present invention. The brushhead 1 and the grip 2 is connected by the shaft 3 (spring not seen). FIG. 2 to 6 are figures showing how to connect the part. The brushhead 11 and the shaft 13 in FIG. 2 are fitted together or connected by a screw (not seen) or with adhesive. As shown in FIGS. 3 and 4, a groove 122 is cut on the inner wall of the cylinder 121 connecting the shaft 13 and the grip 12. The spring 123 is inserted between the shaft 13 and the bottom of the cylinder 121.

The projection 131 on the shaft 13 is fitted into the groove 122 and the packing 14 is fitted in or connected by a screw (not seen) and an orifice 124 is cut at the bottom of the cylinder to avoid vacuum state or pressure state when the user uses the toothbrush.

Water or dirt which is also gotten into the cylinder will flow out from the orifice 124.

Figure 5:
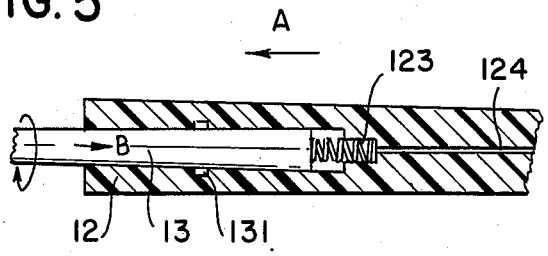
FIG. 5 is a diagram showing the operation of the shaft when the user pushes the grip of the toothbrush of FIG. 2.
Figure 6:
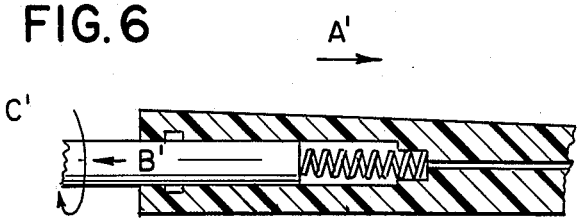
FIG. 6 is a diagram showing the operation of the shaft when the user pulls the grip of the toothbrush of FIG. 2.

As shown in FIG. 5 and 6, when the user moves the grip 12 in the direction of the arrow A, the shaft projection 131 is guided by the groove 122 and moves in the direction of the arrow B in the FIG. 5 and at the same time, the shaft 13 and the brushhead 11 half-rotate in the direction of the arrow C in the FIG. 5. As shown in the FIG. 6, when the grip 12 moves in the direction of the arrow A', the shaft projection 131 is guided along the groove 122 by the reactive force of the arrow B' and at the same time the shaft 13 and the brushhead 11 half-rotate in the direction of the arrow C' completing one round trip of moving up and down by a left-right movement of the user.

Figure 7:
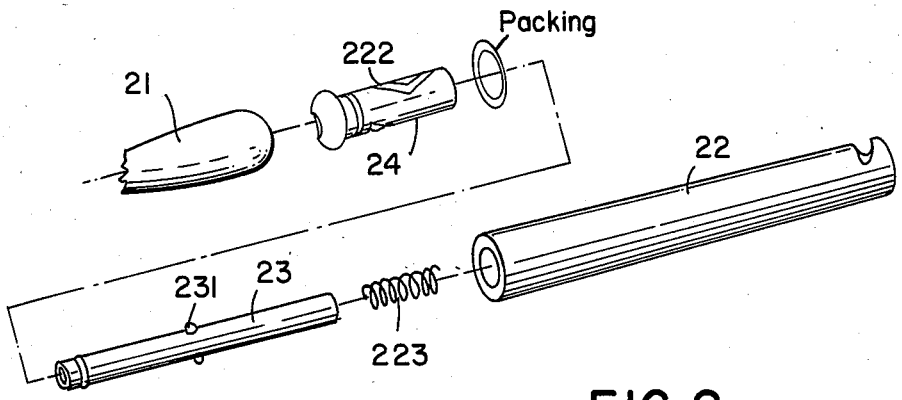
FIG. 7 is a disassembled view explaining relative arrangement among the brushhead, the shaft, the groove part, the packing, the spring and the grip of the second example of the present invention.
Figure 8:
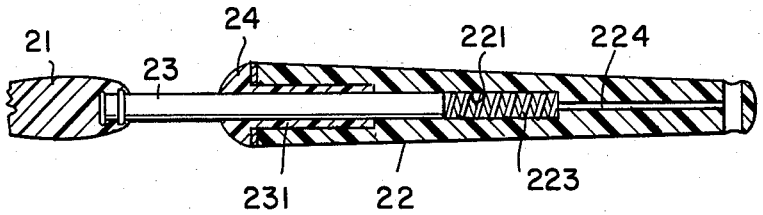
FIG. 8 is a sectional view of the toothbrush of FIG. 7.
Figure 10:
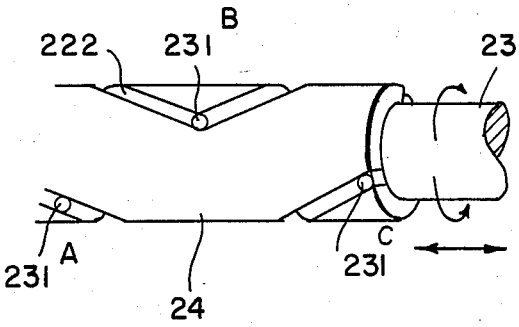
FIG. 10 is a diagram showing the operation of the shaft when the user pulls or pushes the grip of the toothbrush of FIG. 7.
Figure 9:
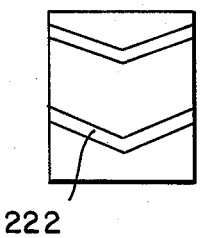
FIG. 9 is an unfolded view showing the groove of FIG. 7.
Figure 11:
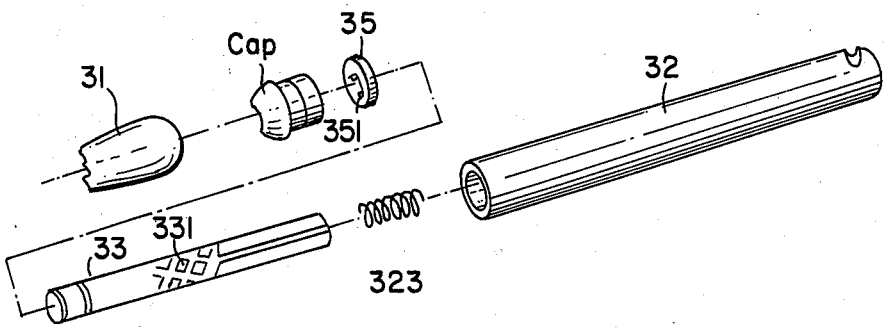
FIG. 11 is a disassembled view explaining relative arrangement among the brushhead, the cap, the packing, the shaft, the spring and the grip of the third example of the present invention.
Figure 12:
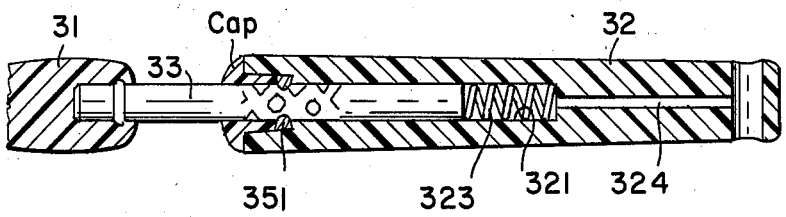
FIG. 12 is a diagram showing the sectional view of the toothbrush of FIG. 11.
Figure 13:
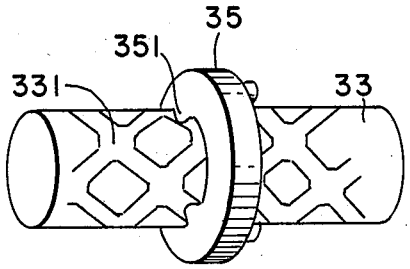
FIG. 13 is an unfolded view showing the groove of FIG. 11.
Figure 14:
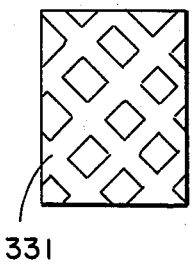
FIG. 14 is an unfolded view showing the groove of FIG. 13.

FIGS. 7 and 10 are the second example of the present invention showing the structure of the toothbrush of the present invention. The brushhead 21 and the shaft 23 are fitted together or connected with a screw (not seen) or with adhesive. The cylinder 221 with a groove 222 in the shape of concave is fitted together with the shaft projection 231 and then the cylinder part 24 is fitted in the cylinder 221 of the grip or connected with the grip by a screw (not seen). A spring 223 is inserted in the cylinder 221 and an orifice 224 is cut to avoid the vacuum state in the cylinder 221.

When the user pulls the grip 22 like the first example the shaft projection 231 is guided by the groove 222 and moves in the direction A-B-C in the FIG. 10 and the shaft 23 and the brushhead 21 complete one round trip of moving up and down. When the user pushes the grip 22, the shaft projection 231 is guided by the groove and moves in the direction C-B-A in FIG. 10 and the brushhead completes one round trip of moving up and down. Therefore, when the user moves the grip right and left, the brushhead completes 2 round trip of moving up and down.

FIG. 11 to 14 are the thrid example of the present invention showing the structure and how to work. The brushhead 31 and the grip 32 are connected by the shaft 33. A cap is fixed to the grip 32 with the interposition of a ring 35 having projection 351. The ring is fixed firmly to the grip 32. The shaft 33 has the groove 331 of net structure and a spring 323 is inserted between the shaft 33 and the bottom of the cylinder 321. An orifice 324 is cut from the bottom of the cylinder to the out of the grip 32. The projection 351 is fitted in the groove 331. When the user pulls or pushes the grip 32 in the right and the left direction like the first or the second example, the projection 351 is guided by the groove 331 and the brushhead moves at random direction along the net structure of the groove 331 without any regular moving pattern like the first or the second example.

In the first example of the present invention, one left and right trip produces only one upward and downward rotative movement but it has a big radius of movement. In the second example, one way trip to the left or the right produces one upward and downward rotative movement having a smaller radius of movement. In the thrid example, one way trip to the left or the right produces random upward or downward rotative movements having much smaller radius of movement.

Thus, the toothbrush of the present invention can be most effectively used for children, adults, men or women.

I claim:

1. A toothbrush comprising:

a brushhead member, a shaft member connected to said brushhead member, said shaft member containing a plurality of net-shaped grooves disposed on the outside surface thereof, a ring member slidably disposed on said shaft member and having a plurality of projecting members disposed thereon for engaging in said plurality of net-shaped grooves, a cap member slidably disposed on said shaft member, a tubular gripping member slidably disposed over said shaft member and said ring member for screw engagement with said cap member, and spring means disposed inside of said tubular gripping member for biasing against the end of said shaft member whereby the toothbrush is longitudinally and rotatably movable within the gripping member.

* * * * *